US007106271B1

(12) United States Patent
Friday

(10) Patent No.: US 7,106,271 B1
(45) Date of Patent: Sep. 12, 2006

(54) NON-OVERLAPPING ANTENNA PATTERN DIVERSITY IN WIRELESS NETWORK ENVIRONMENTS

(75) Inventor: Robert J. Friday, Los Gatos, CA (US)

(73) Assignee: Airespace, Inc., San Jose, CA (US)

( * ) Notice: Subject to any disclaimer, the term of this patent is extended or adjusted under 35 U.S.C. 154(b) by 0 days.

(21) Appl. No.: 10/611,522

(22) Filed: Jun. 30, 2003

(51) Int. Cl.
*H01Q 21/00* (2006.01)

(52) U.S. Cl. ..... 343/853; 342/374; 455/277.1

(58) Field of Classification Search ..... 343/853, 343/882, 702, 893; 342/374, 433, 448; 455/277.1, 455/277.2, 133, 137
See application file for complete search history.

(56) References Cited

U.S. PATENT DOCUMENTS 5,945,954 A * 8/1999 Johnson ..... 343/702
6,085,076 A * 7/2000 Lindsay et al. ..... 455/277.1
6,215,447 B1 * 4/2001 Johnson ..... 343/702
6,335,704 B1 * 1/2002 Nakamura ..... 343/700 MS
6,473,040 B1 * 10/2002 Nakamura ..... 343/700 MS
6,768,457 B1 * 7/2004 Lindenmeier ..... 342/374
2003/0095074 A1 * 5/2003 Scorer et al. ..... 343/772
2003/0137468 A1 * 7/2003 Kim ..... 343/895

* cited by examiner

*Primary Examiner*—Trinh Dinh
*Assistant Examiner*—Huedung Cao Mancuso
(74) *Attorney, Agent, or Firm*—Mark J. Spolyar

(57) ABSTRACT

Methods, apparatuses and systems directed to a wireless network interface supporting directional antenna diversity. Directional diversity, in one embodiment, makes use of antennas with higher gain and non-overlapping patterns to provide communication over a greater area and select the best antenna to receive signals transmitting wireless frames or packets. Certain embodiments optimize wireless network systems using Orthogonal Frequency Division Multiplexed (OFDM) signals where spatial diversity protection provided by spatially-separated, omni-directional antennas is not required. In other embodiments, use and selection of directional antennas allows for sectorization resulting in performance gains such as extended coverage areas, noise reduction, enhanced efficiency, and increased throughput.

20 Claims, 7 Drawing Sheets

NON-OVERLAPPING ANTENNA PATTERN DIVERSITY IN WIRELESS NETWORK ENVIRONMENTS

CROSS-REFERENCE TO RELATED APPLICATIONS

This application makes reference to the following commonly owned U.S. patent applications and patents, which are incorporated herein by reference in their entirety for all purposes:

U.S. patent application Ser. No. 10/155,938 in the name of Patrice R. Calhoun, Robert B. O'Hara, Jr. and Robert J. Friday, entitled "Method and System for Hierarchical Processing of Protocol Information in a Wireless LAN;" and U.S. patent application Ser. No. 10/407,357 in the name of Patrice R. Calhoun, Robert B. O'Hara, Jr. and Robert J. Friday, entitled "Method and System for Hierarchical Processing of Protocol Information in a Wireless LAN."

FIELD OF THE INVENTION

The present invention relates to wireless signals and, more particularly, to methods, apparatuses and systems directed to non-overlapping antenna pattern diversity in wireless network environments.

BACKGROUND OF THE INVENTION

A wireless Local Area Network is a wireless communication system with radios having relatively high throughput and short coverage ranges. Many wireless LANs are based on iterations of the IEEE 802.11 standard. Radio signals passing between a transmitter and a receiver in an indoor environment are reflected from many surfaces of objects in that environment. This results in the radio signal following many different paths between the transmitter and receiver. This phenomenon is called "multipath."

When the coherence bandwidth of the RF channel is on the same order as the signal bandwidth of the signal, multipath in a radio system using most narrow-band or spread spectrum communication techniques results in interference at the receiver that must be addressed. This interference is a result of the radio receiver performing a vector addition of all the signals received from all of the various paths they follow between the transmitter and receiver. This vector addition can result in a very weak resultant signal (destructive interference) or a strong resultant signal (constructive interference).

Whether the resultant signal detected at the receiver is affected by destructive or constructive interference is a function of the relative positions of the transmitter, receiver, and all other objects that reflect the radio signal along paths between the transmitter and receiver. Because the spatial relationship between all these objects is the determining factor in the result of the vector addition of the received signals, moving the transmitter or receiver by a small amount (on the order of a wave length) will have a significant effect on the resultant signal.

For modulation methods based on modulating a single carrier, spatial diversity takes advantage of this characteristic (i.e., that moving one antenna a small distance can have a great effect on the resultant received signal), by separating two or more antennae by a wavelength or more and sampling the received signal at each antenna, before choosing one of the antennae to be used for reception. This spatial diversity technique uses antennae with patterns (coverage areas) that are typically similar and overlapping. If the patterns did not overlap, the effect of using the antennae for spatial diversity would be reduced. Recently, techniques other than single carrier modulation have been used for radio WLAN communication. Specifically, Orthogonal Frequency Division Multiplexing (OFDM) has been utilized. OFDM is a broadband communication mechanism that addresses the multipath issue in the design of the modulated signal itself. Therefore, spatial diversity has diminished utility with this type of radio signal.

Despite the use of OFDM, the need remains for further optimizing signal reception between transmitters and receivers. For example, a need in the art exists for increasing the coverage area of the radios associated with access points to enable reductions in the number of access points required to adequately implement a wireless network environment. A need also exists for maintaining user performance, network efficiency, and data throughput under increased user load in a wireless network environment. Embodiments of the present invention substantially fulfill these needs.

SUMMARY OF THE INVENTION

The present invention provides methods, apparatuses and systems directed to a wireless network interface supporting directional antenna diversity. Directional diversity, in one embodiment, makes use of antennas with higher gain and non-overlapping patterns to provide communication over a greater area and select the best antenna to receive signals transmitting wireless frames or packets. Certain embodiments optimize wireless network systems using Orthogonal Frequency Division Multiplexed (OFDM) signals where spatial diversity protection provided by spatially-separated, omni-directional antennas is not required. In other embodiments, use and selection of directional antennas allows for sectorization resulting in performance gains such as extended coverage areas, noise reduction, enhanced efficiency, and increased throughput.

DESCRIPTION OF PREFERRED EMBODIMENT(S)

Figure 1A:
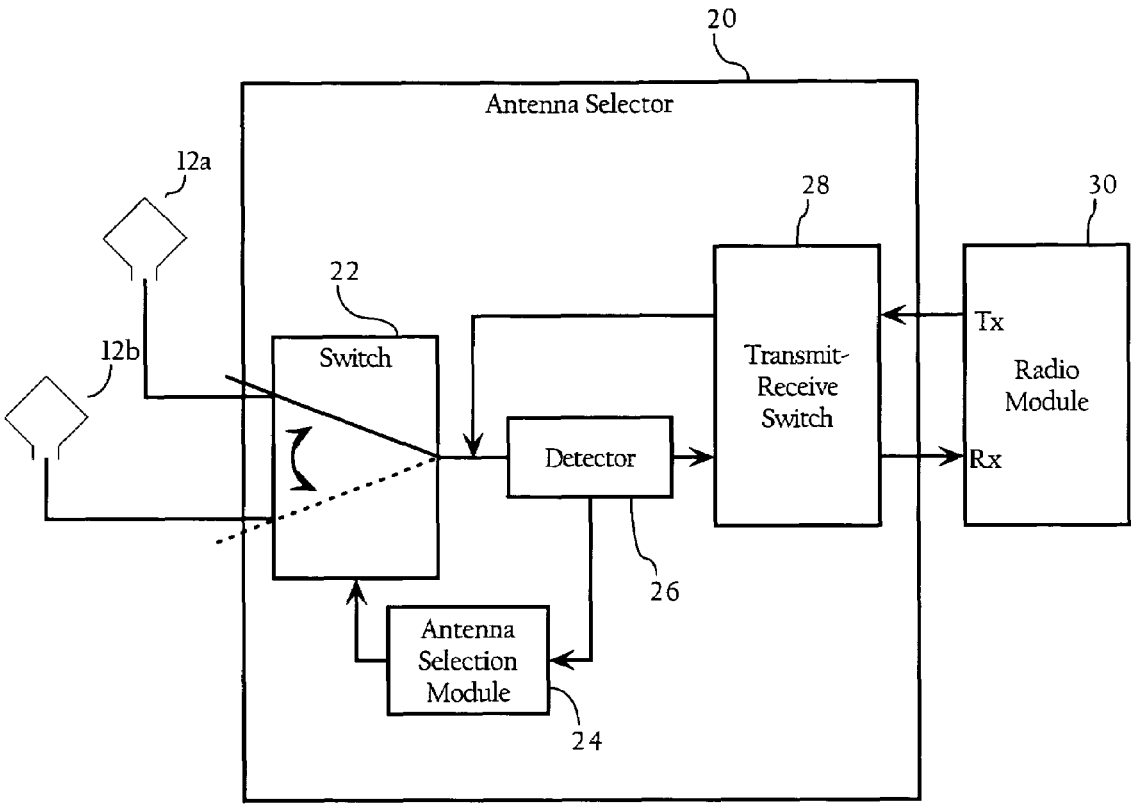
FIG. 1A is a functional block diagram illustrating an antenna selector according to an embodiment of the present invention.
Figure 1B:
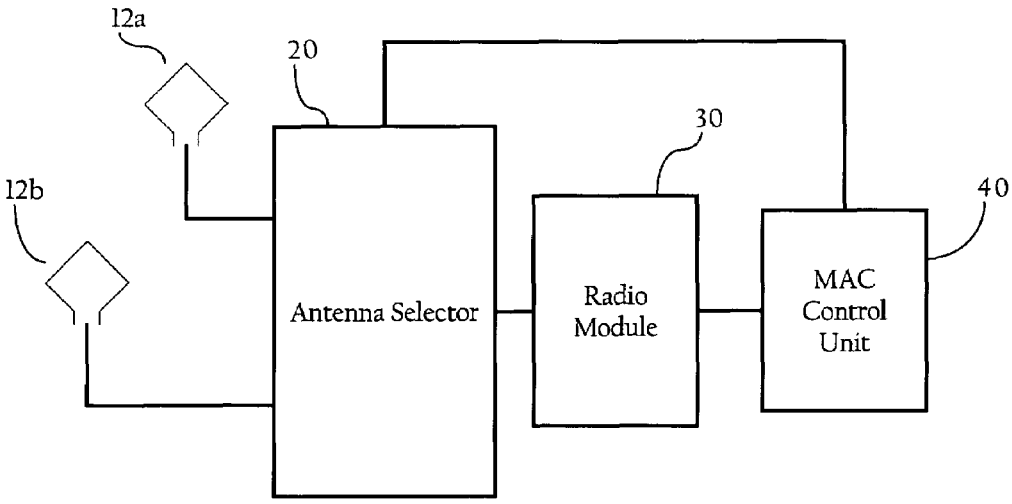
FIG. 1B is a functional block diagram showing a wireless network interface unit according to an embodiment of the present invention.

FIG. 1A illustrates an antenna selector 20, according to an embodiment of the present invention. As FIG. 1B illustrates, the transmit receive unit 20, in one embodiment, is part of a wireless network interface unit 60 comprising antennas 12*a*, 12*b*, antenna selector 20, radio module 30, and MAC control unit 40. In one embodiment, the functionality described herein can be implemented in a wireless network interface chip set, such as an 802.11 network interface chip set. Radio module 30 includes frequency-based modulation/demodulation functionality for, in the receive direction, demodulating radio frequency signals and providing digital data streams, and in the transmit direction, receiving digital data streams and providing frequency modulated signals corresponding to the digital data stream. In one embodiment, radio module 30 is an Orthogonal Frequency Division Multiplexed modulation/demodulation unit. In one embodiment, radio module 30 implements the OFDM functionality in a manner compliant with the IEEE 802.11a and 802.11g protocol. MAC control unit 40 implements data link layer functionality, such as detecting individual frames in the digital data streams, error checking the frames, and the like. In one embodiment, MAC control unit 40 implements the 802.11 wireless network protocol. Other suitable wireless protocols can be used in the present invention.

Figure 3:
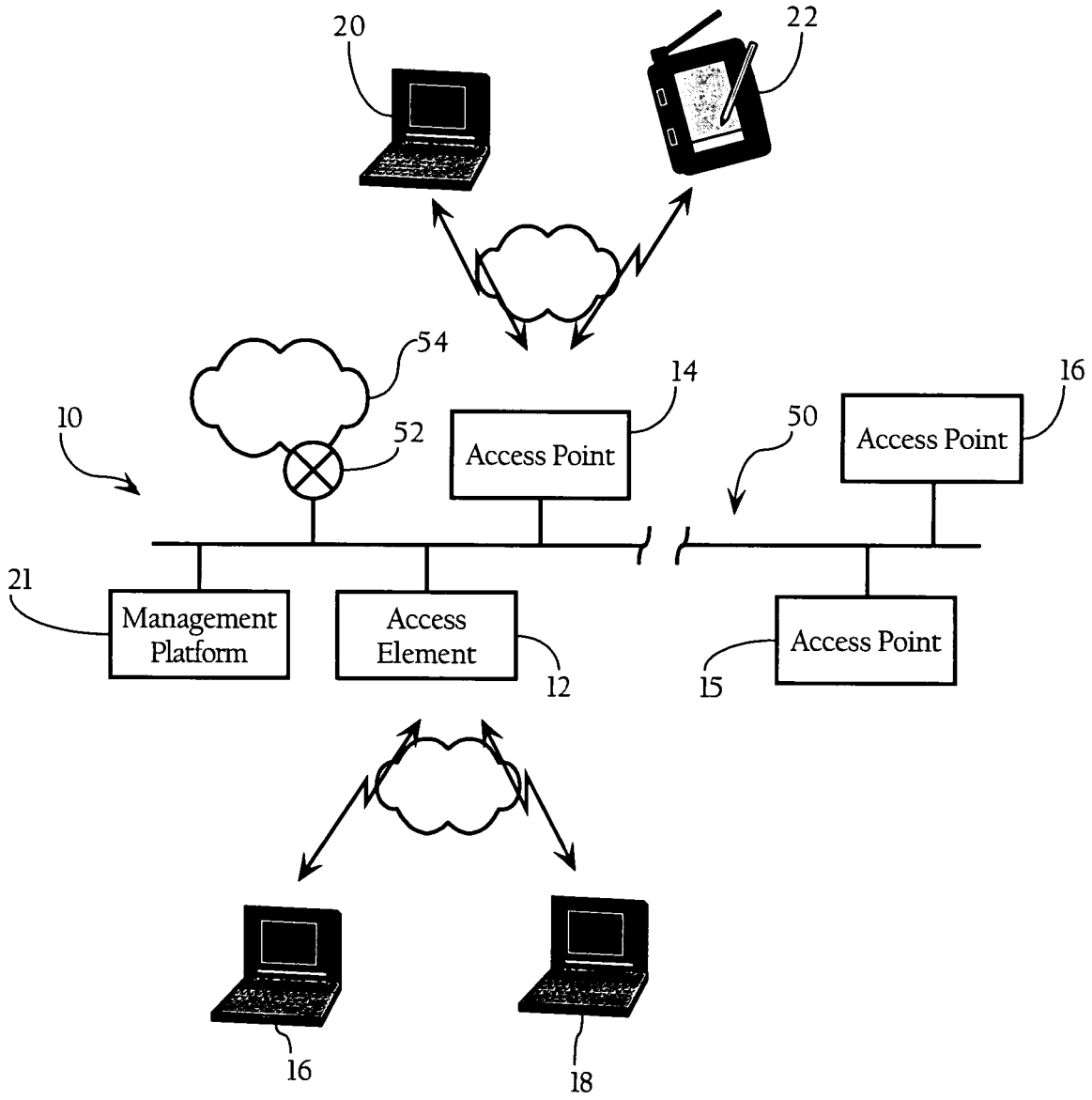
FIG. 3 is a functional block diagram illustrating a wireless network system into which the antenna selection functionality of the present invention may be integrated.

In one embodiment, the wireless network interface unit can be incorporated into wireless network access points, such as access points 12, 14, 15, and 16 shown in FIG. 3. In other embodiments, the wireless network interface unit can be incorporated into a wireless network system featuring hierarchical processing of wireless protocol information, as described in U.S. application Ser. Nos. 10/155,938 and 10/407,357.

Figure 6A:
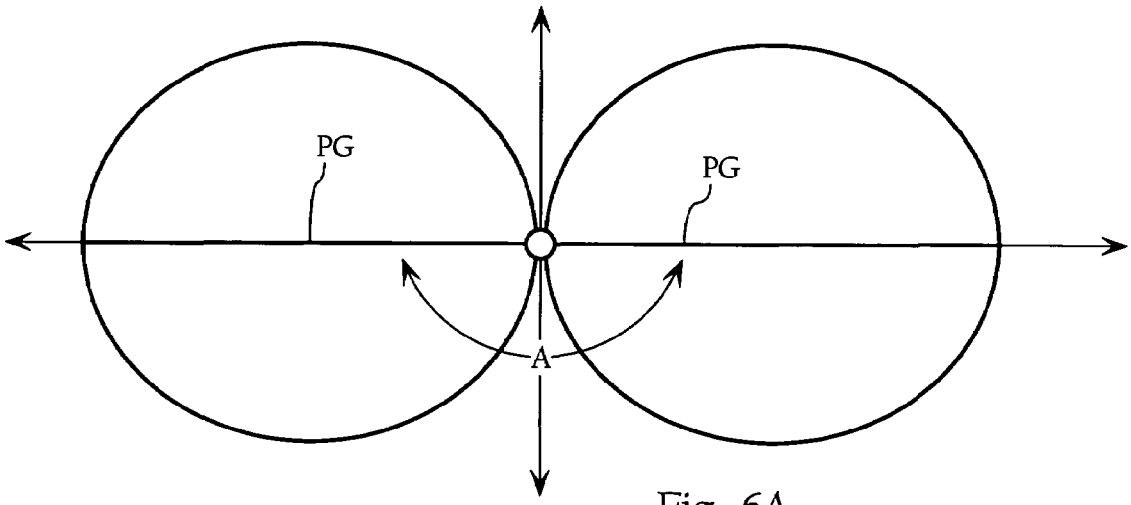
FIGS. 6A, 6B and 6C are plots illustrating the possible orientation of a plurality of antennas according to the offset of peak gain according to difference embodiments of the present invention.
Figure 6B:
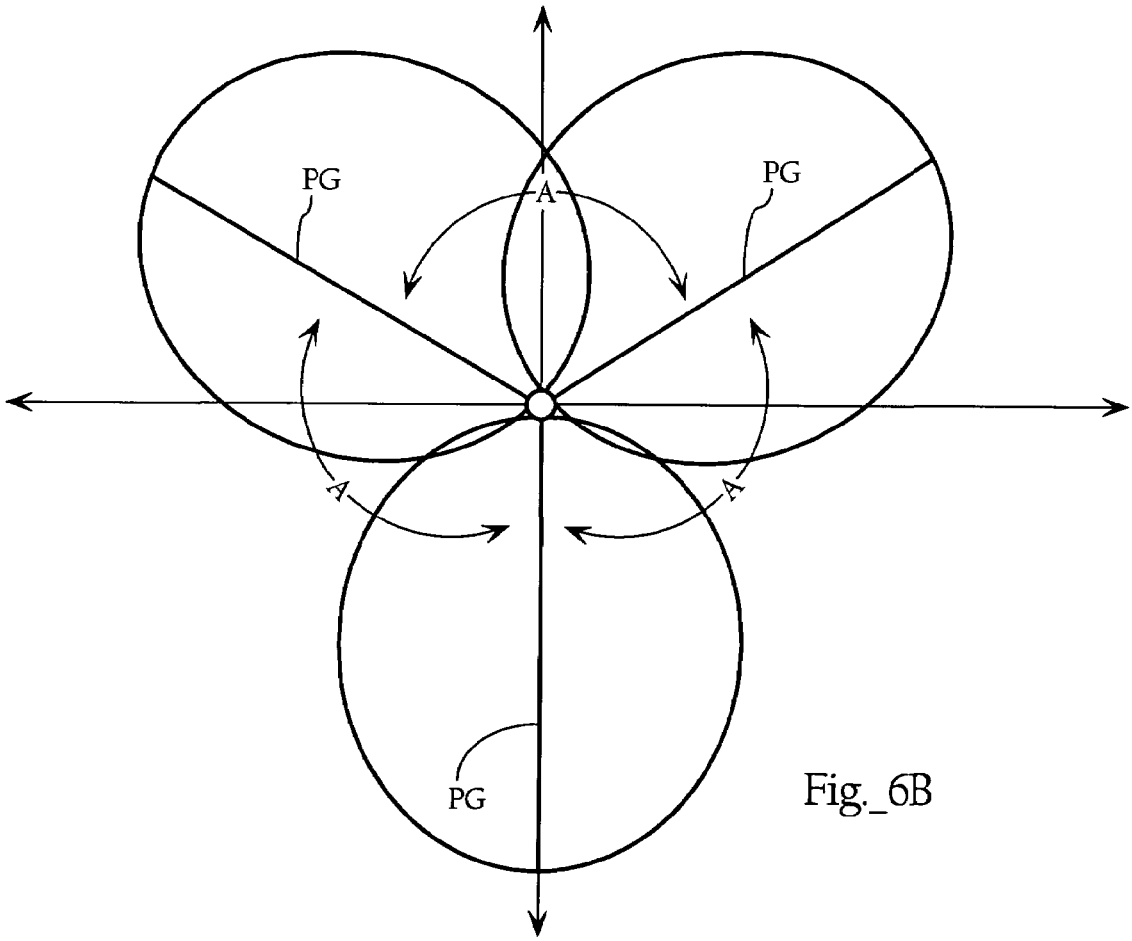
Figure 6C:
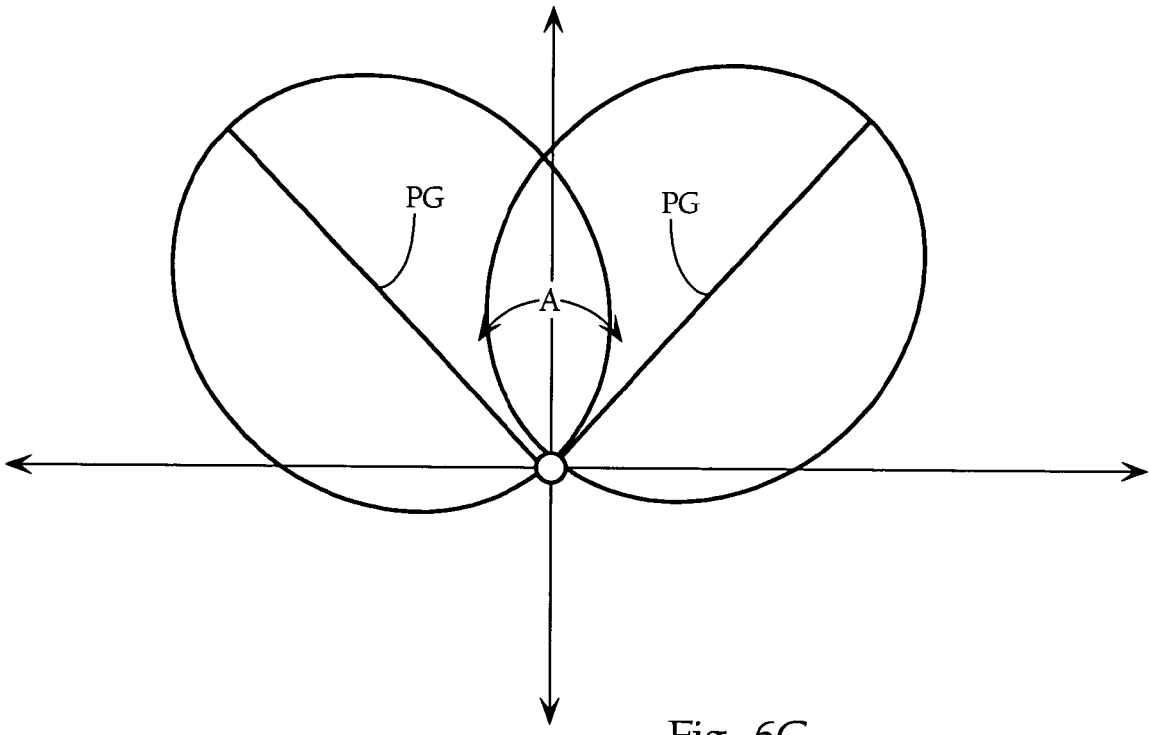

Antenna selector 20 is operative to receive signals transduced by antennas 12*a*, 12*b*, select an antenna based on detected signal attributes associated with the antennas, and provide the signal corresponding to the selected antenna to radio module 30. Antennas 12*a*, 12*b* are directional antennas having non-overlapping patterns. Although the various Figures show two antennas, the present invention can operate in conjunction with more than two directional antennas having substantially non-overlapping patterns. Antennas 12*a*, 12*b* can be any suitable directional antennas, such as patch antennas, yagi antennas, parabolic and dish antennas. In one embodiment, the peak gains of the antennas are offset from one another in a manner that maximizes coverage in all directions. In one embodiment, the peak gains of the antennas are oriented relative to each other at an angle A about the vertical or z-axis, where A is equal to 360/n degrees±10 degrees (where n is the number of antennas). Accordingly, for a two-antenna system (see FIG. 6A), the peak gains PG of the antennas are oriented at about 180 degrees from each other about the vertical axis. For a three-antenna system (see FIG. 6B), the peak gains PG of the antennas are oriented at about 120 degrees from each other, and so on. In other embodiments, the peak gains of the antennas can be offset from one another at other angles determined according to other factors or criteria. For example, the peak gains of two antennas located at the end of a room may be offset at 90 degrees relative to each other (see FIG. 6C). As one skilled in the art will appreciate, embodiments of the present invention essentially effect a sectorization capability to the access point or other device including the antenna selection functionality described herein. As to access points, embodiments of the present invention enhance performance under load conditions in that, by selecting a given antenna, the effect of noise and other signal interference sources emanating from behind the selected antenna are greatly attenuated or cutoff. Furthermore, this sectorization also reduces the potential of detecting packets emanating from wireless stations not in the coverage area of the selected antenna that, pursuant to the collision avoidance mechanisms in the 802.11 protocol, would prevent the access point from transmitting. In addition, the use of directional antennas (over omni-directional antennas) results in increased performance. For example and in one embodiment, the use of a directional antenna can result in coverage gains of 6 to 8 dBi, while the typical gain associated with an omni directional antenna is 0 to 2 dBi.

As FIG. 1A illustrates, antenna selector 20, in one embodiment, comprises switch 22, antenna selection module 24 and detector 26. Switch 22 is operative to switch between a plurality of antennas, such as antennas 12*a*, 12*b*, under control signals provided by antenna selection module 24. Detector 26 detects at least one attribute of the signal received at the antennas, as discussed more fully below. Antenna selection module 24 receives signal attributes from the detector 26 and provides control signals to switch 22 to switch among the available antennas. Antennas selection module 24, in one embodiment, further includes control logic for selecting an antenna for receipt of a signal corresponding to a packet or frame, as discussed more fully below. As FIG. 1A illustrates, antenna selector 20 may further include transmit/receive switch 28 to allow signals in the transmit direction to by-pass detector 26. As discussed below, other architectures are possible.

Detector 26 can detect one to a plurality of signal attributes, such as signal strength, signal-to-noise ratio, etc. In one embodiment, the functionality of detector 26 is embodied within an integrated circuit. One skilled in the art will recognize that such signal attribute detection functionality is part of standard 802.11 wireless chip sets. As to signal strength, the detector 26 can provide absolute signal strength values, such as decibels (dBs) or relative indicators, such as RSSI values.

Antenna selection module 24, during the preliminary or preamble portion of the signal, evaluates the signals received at each antenna, such as antenna 12*a* and 12*b*, and selects an antenna for receipt of the remaining signal data corresponding to the wireless packet or frame. For example, according to the 802.11 protocol, MAC sublayer data units are mapped into a framing format suitable for wireless transmission. The MAC sublayer data units, according to the 802.11 protocol, are essentially encapsulated by a PLCP preamble and a PLCP header, thereby forming a PLCP protocol data unit (PPDU). The PLCP header generally includes a SYNC field and Start Frame Delimiter (SFD). The SYNC field allows the receiver to perform necessary operations for synchronization, while the SFD indicates the start of PHY-dependent parameters in the PLCP header. According to the 802.11 protocol, once the signal associated with the synchronization field is detected, the PHY layer functionality of the receiver searches for the SFD to begin processing the PHY-dependent parameters in the PLCP header. In one embodiment, during receipt of the preamble, antenna selection module 24 evaluates the signals transduced by antennas 12*a*, 12*b* (as provided by detector 26) and selects an antenna based on the detected signal attributes. The selected antenna is the used to receive the signal for the remainder of the PPDU. In one embodiment, the acknowledgment (ACK) frame is transmitted from the same antenna originally selected to receive the signal from the wireless station.

Figure 4:
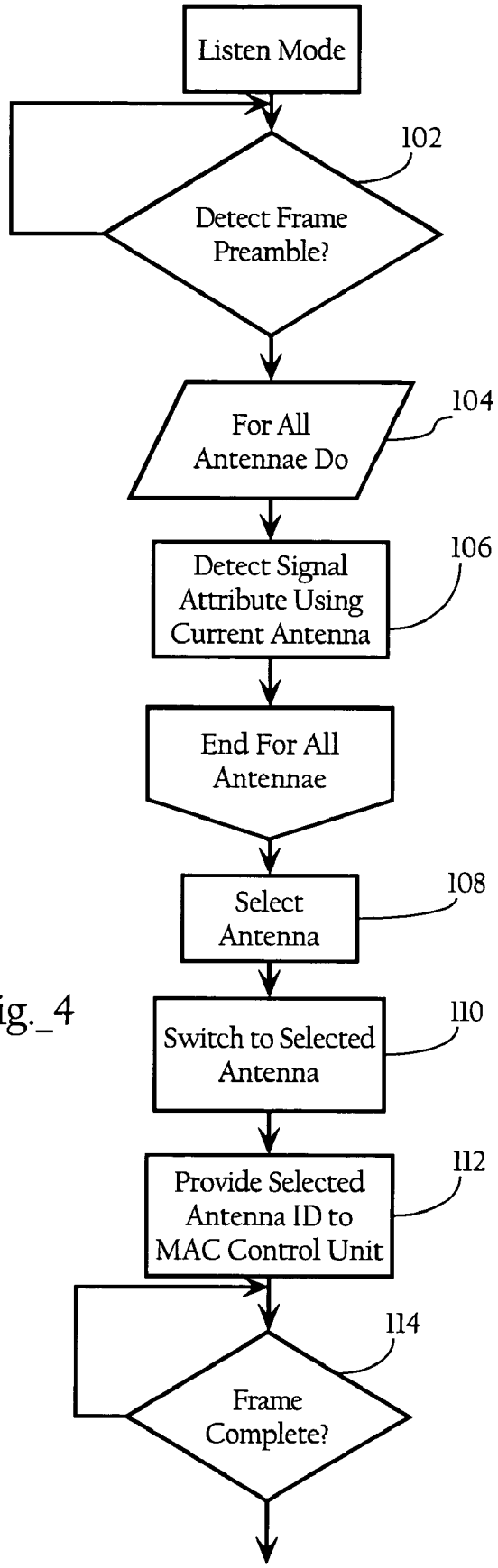
FIG. 4 is a flow chart diagram providing a method, according to an embodiment of the present invention, directed to the selection of an antenna during receipt of a wireless frame.

FIG. 4 illustrates a method, according to an embodiment of the present invention, directed to selecting an antenna during receipt of the frame preamble. In the listening mode, the radio can operate in either a slow or fast receive diversity scheme when listening for wireless frames. For example, in a slow receive diversity scheme, the radio switches to another antenna if no signal is detected on the current antenna within a threshold period of time. In a fast receive diversity scheme, the radio at the listen state switches frequently (e.g., every 1 to 3 microseconds) between the available antennas. As FIG. 4 shows, when a frame preamble is detected, antenna selection module 24 selects a first antenna and transmits control signals to switch 22 which switches the circuit to allow signals received at the selected antenna to pass to detector 26. Detector 26, as discussed above, detects at least one attribute of the received signal. Antenna selection module 24 then selects another antenna, transmitting control signals to switch 22. This process is repeated, in one embodiment, for all antennas connected to switch 22. The time spent detecting the signal attribute(s) for each antenna depends on both the number of antennas and the length of the frame preamble (as defined by the wireless networking protocol employed). For example, in a wireless network employing the IEEE 802.11g protocol, the long PLCP preamble is 128 microseconds. Accordingly, assuming that two antennas are used, antenna selection module 24 can allocate a maximum of about 128 microseconds to detect the signal attributes for each antenna and to make a selection. Of course, the use of additional antennas reduces this maximum number of samples per antenna that can be used to select an antenna. After the signals of all antennas have been analyzed, antenna selection module 24 selects one of the antennas to be used for receipt of the remainder of the frame (108). Antenna selection is based on the detected signal attribute(s). For example, antenna selection module 24, in one embodiment, selects the antenna associated with the highest signal strength. In another embodiment, antenna selection can be based on the observed signal-to-noise ratio. In yet another embodiment, antenna selection can be based on both signal strength and signal-to-noise ratios, where the two factors can be weighted. Of course, antenna selection can be driven by other considerations, such as the historical performance of a given antenna versus the other antennas. As FIG. 4 shows, antenna selector 24 then transmits control signals to switch 24 designating the selected antenna (110).

In one embodiment, the antenna selection module 24 provides the identifier corresponding to the selected antenna to radio module 30 or MAC control unit 40 (112). MAC control unit 40 can then store the selected antenna identifier and the MAC address in a table or other suitable data structure. In one embodiment, the identifier corresponding to the selected antenna is later stored in association with the MAC address of the source transmitter or wireless client. As discussed below, this is used, in one embodiment, to select an antenna for transmission of frames to the wireless client.

As FIG. 4 illustrates, after receipt of the frame is completed (114), other operations can be performed. For example, an acknowledgment (ACK) frame can be transmitted to indicate that the frame was properly received. In one embodiment, the antenna selected to receive the frame is used to transmit the acknowledgment frame. Of course, other frames can also be transmitted to the wireless client, such as authorization response frames and association response frames. After completion of such operations, the system resumes the listen mode, assuming no frames are to be sent.

Figure 5:
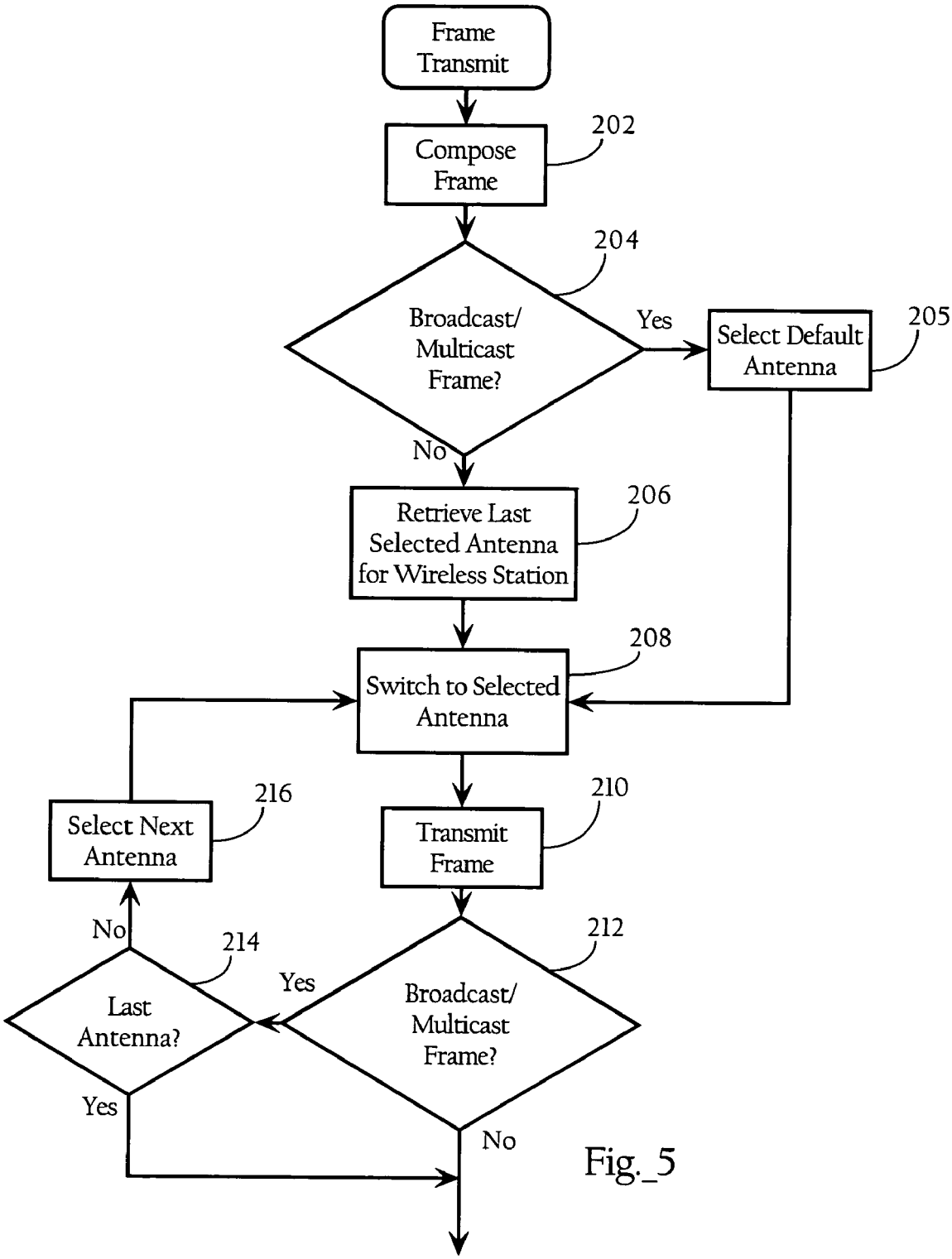
FIG. 5 is a flow chart diagram setting forth a method, according to an embodiment of the present invention, associated with selection of an antenna for transmission of a wireless frame.

FIG. 5 provides a method, according to an embodiment of the present invention, directed to the transmission of wireless frames. In one embodiment, MAC control unit 40 composes a frame for transmission (202). If the frame is not to be multicast or broadcast (204), MAC control unit 40 retrieves the antenna identifier, if any, associated with the destination MAC address (206). The antenna identifier is provided to antenna selector 20 which switches to the identified antenna (208) for transmission of the frame (210). In one embodiment, the system uses the same selected antenna to listen for an acknowledge or other responsive frame.

If the frame is a multicast or broadcast frame, such as a Beacon Frame, in one embodiment, a default antenna is selected (205) and used to transmit the frame. As FIG. 5 shows, after initial transmission of the frame, if the frame is to be multicast or broadcast (212), the next antenna is selected (216) and the frame is retransmitted (210). This process, in one embodiment, is repeated for all available antennas (214).

Figure 2A:
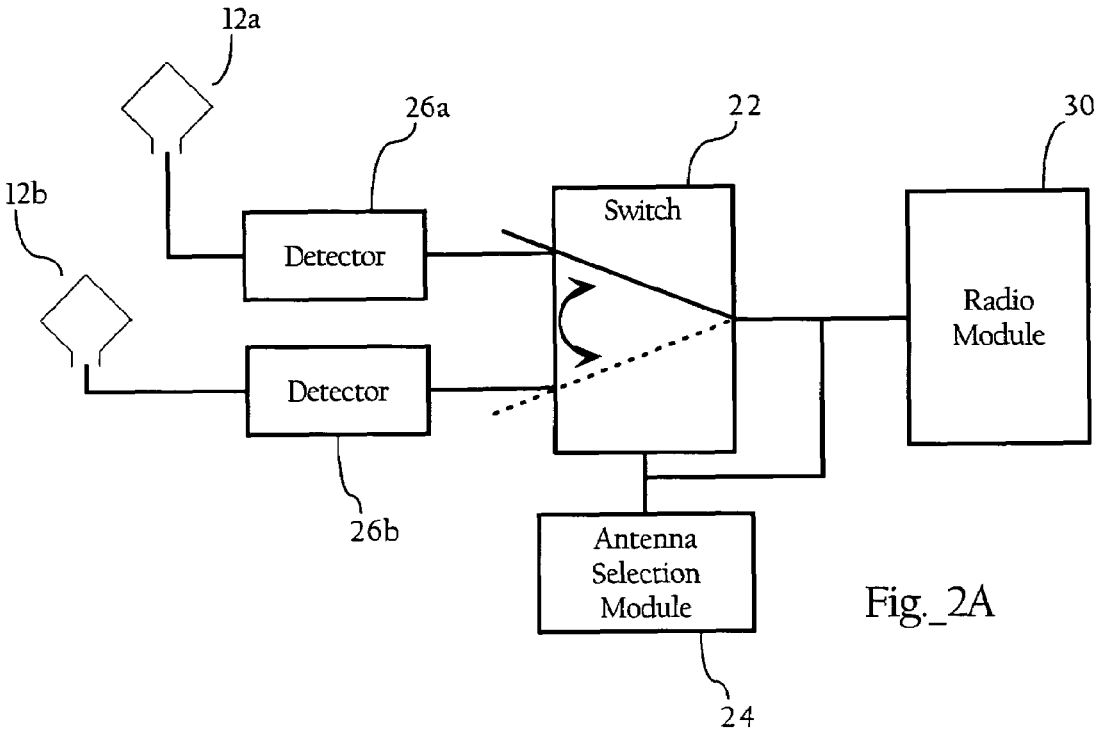
FIG. 2A is a functional block diagram providing an antenna selector according to a second embodiment of the present invention.
Figure 2B:
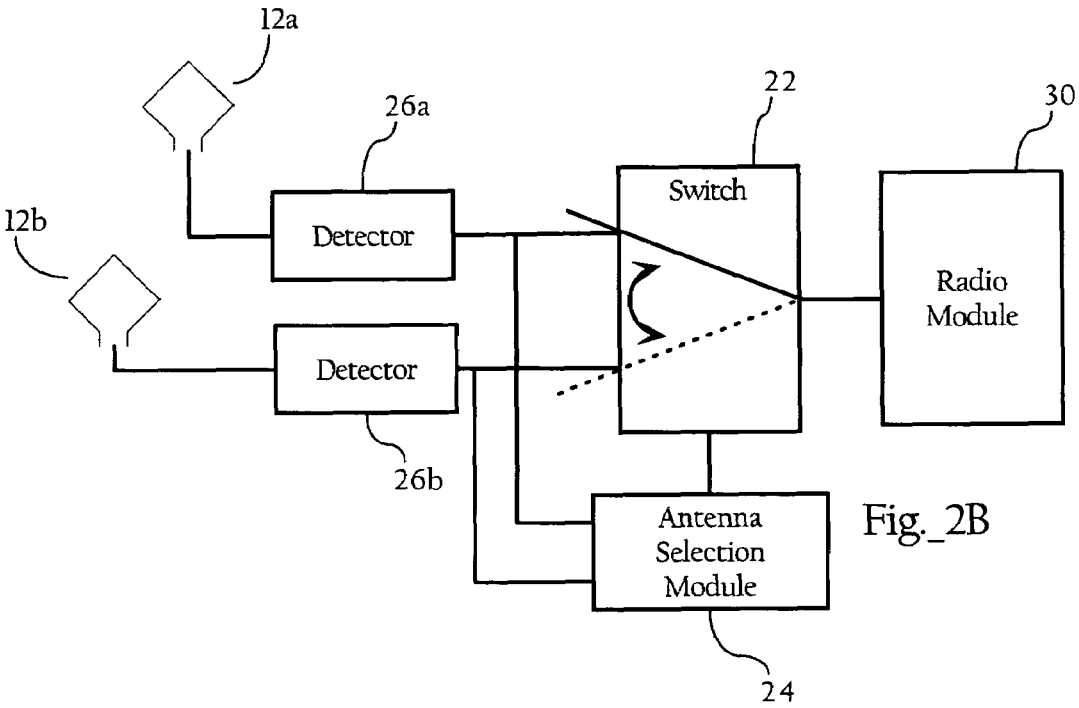
FIG. 2B is a functional block diagram setting forth an antenna selector according to a third embodiment of the present invention.

Other embodiments of antenna selector are possible. FIGS. 2A and 2B illustrate alternative embodiments of antenna selector 20. Whereas, in the embodiment depicted in FIG. 1B, the detection of signal attributes associated with each antenna occurs in serial, the antenna selectors 20 depicted in FIGS. 2A and 2B operate in a parallel manner. Specifically, in the embodiment of FIG. 2A, parallel detectors 26*a*, 26*b* provide the signal attributes associated with antennas 12*a*, 12*b* to antenna selection module 24 via switch 22. In this embodiment, antenna selection module 24 obtains the signal attributes from detectors 26*a*, 26*b* in a serial manner by transmitting control signals to switch 22. Similarly, in the embodiment shown in FIG. 2B, detectors 26*a*, 26*b* provide the detected signal attributes directly to antenna selection module 24, which analyzes the attributes, selects an antenna for receipt of the frame, and transmits corresponding control signals to switch 22.

The invention has been explained with reference to specific embodiments. Other embodiments will be evident to those of ordinary skill in the art. For example, the antenna selection functionality according to the present invention can be incorporated into wireless clients in addition to access points, assuming the wireless clients are equipped with more than one directional antenna. It is, therefore, intended that the claims set forth below not be limited to the embodiments described above.

What is claimed is:

1. An apparatus for enhancing operation of wireless network environment, comprising a plurality of directional antennas oriented about an axis, wherein the plurality of directional antennas have substantially non-overlapping patterns relative to each other, wherein the peak gains of the plurality of directional antennas are oriented radially and outwardly about the axis and offset relative to each other at an angle substantially equal to 360/N, where N is the number of directional antennas in the plurality of directional antennas; wherein the plurality of directional antennas are each operative to transduce a radio frequency signal and provide an output signal corresponding to the radio frequency signal;

a switch operatively connected to the plurality of antennas and operative to switch between the antennas in response to control signals;

a detector operative to detect at least one signal attribute of the output signals provided by the directional antennas; and an antenna selection module operative, during receipt of the preamble of a wireless frame, to provide control signals to the switch designating selected directional antennas in the plurality of directional antennas, evaluate the respective output signals provided by the selected antennas, and select a directional antenna from the plurality of directional antennas for receiving the radio frequency signal associated with the wireless frame.

2. The apparatus of claim 1 further comprising a radio module operatively connected to the switch for receiving output signals from one of the plurality of directional antennas selected by the antenna selection module.

3. The apparatus of claim 2 wherein the radio module is operative to demodulate the received output signals into digital data streams.

4. The apparatus of claim 2 further comprising a data link control unit operative to process the digital data streams and identify frames from the digital data streams.

5. The apparatus of claim 4 wherein the antenna selection module is further operative to identify the selected directional antenna to the data link control unit, and wherein the identified frames include a source address, and wherein the data link control unit is operative to store the identified directional antenna in association with the source address in the frames in a data structure.

6. The apparatus of claim 5 wherein the data link control unit is operative to compose a frame for transmission to a destination, retrieve the antenna identifier associated with the destination address in the data structure, transmit control signals to the switch designating the retrieved antenna for use in transmitting the composed frame.

7. The apparatus of claim 5 wherein the data link control unit is operative to transmit a frame acknowledging the received frame.

8. The apparatus of claim 7 wherein the acknowledging frame is transmitted using the directional antenna selected to receive the frame.

9. The apparatus of claim 1 wherein at least one directional antenna is a patch antenna.

10. The apparatus of claim 1 wherein at least one directional antenna is a yagi antenna.

11. The apparatus of claim 1 wherein at least one directional antenna is a parabolic antenna.

12. The apparatus of claim 1 wherein the plurality of directional antennas are configured to maximize the coverage area provided by the plurality of directional antennas.

13. The apparatus of claim 1 wherein the plurality of directional antennas are configured to provide radio frequency coverage in all directions.

14. The apparatus of claim 1 wherein the switch, in a listen mode, is operative to switch between the directional antennas before a wireless frame is detected.

15. In a wireless network system comprising a plurality of directional antennas oriented about an axis, wherein the plurality of directional antennas have substantially non-overlapping patterns relative to each other, and wherein the peak gains of the antennas are oriented radially and outwardly about the axis and offset relative to each other at an angle substantially equal to 360/N, where N is the number of directional antennas in the plurality of directional antennas, a method comprising detecting a signal transduced by one of the directional antennas, wherein the signal transmits a wireless frame, the wireless frame including a preamble;

during receipt of the preamble of the frame, selecting one from the plurality of the directional antennas based on at least one attribute of the respective signals transduced by the antennas;

switching to the selected directional antenna for receipt of the remainder of the frame.

16. The method of claim 15 further comprising demodulating the signal to provide a digital data stream, recovering a data packet from the digital data stream.

17. The method of claim 16 further comprising transmitting an acknowledgement frame using the selected directional antenna.

18. The method of claim 15 wherein the signal is a frequency-division multiplexed signal.

19. The method of claim 15 wherein the signal is an orthogonal frequency-division multiplexed signal.

20. An apparatus for enhancing operation of wireless network environment, comprising a plurality of directional antennas oriented about an axis, wherein the plurality of directional antennas have substantially non-overlapping patterns relative to each other, and wherein the peak gains of the plurality of antennas are oriented radially and outwardly about the axis and offset relative to each other at an angle substantially equal to 360/N, where N is the number of directional antennas in the plurality of directional antennas;

a switch operatively connected to the plurality of antennas and operative to switch between the antennas in response to control signals;

a detector operative to detect at least one signal attribute of the signals transduced the antennas; and an antenna selection module operative, during receipt of the preamble of a wireless frame, to provide control signals to the switch designating a selected antenna, evaluate signal attributes provided by the detector, select an antenna from the plurality of antennas for receiving the signal associated with the wireless frame; and an orthogonal frequency division multiplexed (OFDM) module operative to receive the signal from the switch, and recover a digital data stream from the signal.

* * * * *